United States Patent [19]

Waas

[11] 3,985,091

[45] Oct. 12, 1976

[54] ICEBREAKER VESSEL

[76] Inventor: Heinrich Waas, Am Stadtwald 50, 53 Bonn-Bad Godesberg, Germany

[22] Filed: Feb. 21, 1975

[21] Appl. No.: 551,720

[30] Foreign Application Priority Data

July 2, 1974 Germany ..... 2431650
Jan. 29, 1975 Germany ..... 7502495[U]

[52] U.S. Cl. ..... 114/40; 114/56
[51] Int. Cl.[2] ..... B63B 35/08
[58] Field of Search ..... 114/40–42, 114/56; 115/14

[56] References Cited

UNITED STATES PATENTS

| | | | |
|---|---|---|---|
| 2,401,126 | 5/1946 | Weaver et al. | 114/56 |
| 2,883,957 | 4/1959 | Ehinger | 114/42 |
| 2,953,113 | 9/1960 | Baer | 114/56 |
| 3,438,350 | 4/1969 | Gallin | 114/56 |
| 3,636,904 | 1/1972 | Blanchet | 114/41 |
| 3,742,893 | 7/1973 | Stelling | 115/14 |

*Primary Examiner*—Stephen G. Kunin
*Assistant Examiner*—Sherman D. Basinger
*Attorney, Agent, or Firm*—Toren, McGeady and Stanger

[57] ABSTRACT

An icebreaker vessel formed of a pontoon-shaped forecastle, a wedge-shaped ship bottom with a center keel, at least one pair of additional marine propulsion and steering systems along the ship bottom on either side of the keel, trimming devices for lifting or lowering the forecastle by predetermined amounts, and driven wheel assemblies mounted along both sides of the forecastle. The pontoon-shaped forecastle portion is of a larger width than the remaining part of the ship's hull. The additional marine propulsion and steering systems may consist of Voith-Schneider propellers or of one or several pairs of jet propulsion units. Portions of the forecastle and the wheel assemblies may be heated by hot cooling water supplied from the vessel's engines.

10 Claims, 19 Drawing Figures

ICEBREAKER VESSEL

The present invention relates to a multi-purpose icebreaker vessel adapted to operate in varying ice conditions.

Icebreaker vessels when traversing a continuous ice sheet initially apply breaking forces to the ice by means of the stem. These breaking forces form part of the overall resistance against the vessel's forward movement through the ice. Another part of this forward motion resistance consists in work due to friction of the broken ice pieces or floes which slide along the ship bottom and along the opposite side walls of the hull. This friction resistance may attain considerable magnitudes, particularly in rather long vessels, and may constitute a major portion of the overall forward motion resistance. When an icebreaker clears a channel in the ice for the passage of merchant ships, the ice floes sliding along the bottom and the side walls of the icebreaker vessel entail the further drawback that these floes will again emerge and then float in the opened channel behind the icebreaker vessel, in thereby impeding the passage of merchant ships. For these reasons the designers of icebreaker vessels heretofore have always attempted to arrive at an icebreaker design which allows to clear ice-free channels.

On the other hand the recent development in ships for traversing thick ice sheets has tended in the direction of higher and higher propulsive outputs which in turn render questionable the economy of such vessels, due to the increased operational costs of the machine units. In all of these developments, the conventional pointed shape of the forecastle of the icebreaker vessel has been retained, with the exception of minor variations, although this configuration is disadvantageous, particularly in continuous ice sheets: The inclined stem with a substantially wedge-shaped configuration will be pushed onto the ice sheet by propeller thrust and fractures by its weight the ice sheet but merely in a substantially central region. This broken ice region must then be widened into a channel having the width of the ship. This widening brings about the so-called "shoulder effect" which demands much energy. Another drawback is the fact that ice floes tend to become jammed in the narrow channel between the ship's side walls and the lateral edges of the rigid ice sheet, thereby resulting in additional friction forces.

In another approach, there have also been proposed apparatus for cutting into the ice sheet in front of the forecastle. The mounting of such apparatus on the body of the ship is critical, and the mounting assemblies cannot stand up to the unusual high forces involved in ice breaking operations. Furthermore forecastles of a larger width have been proposed. Although vessels of this type have produced some successful results in continuous ice sheets, such vessels do not push sideward ice floes of drift ice. In varying ice conditions, i.e., when drift ice may be expected, vessles of this type are unsuitable.

It is now an object of the present invention to provide a novel and improved ice breaker vessel.

It is another object of the present invention to provide an icebreaker vessel having a reduced frictional resistance.

It is a further object of the present invention to provide an icebreaker vessel of the above type which is suitable for varying ice conditions and of a more economical operation than heretofore known vessels.

It is a still further object of the present invention to provide an icebreaker vessel of the above type which allows to overcome the above stated drawbacks, in having an increased icebreaking efficiency, without increasing the performance or power of the vessel.

In accordance with the present invention there is now proposed an icebreaker vessel which is characterized by the combination of:

a. a ship's hull with forecastle and stern, the side walls of the hull in a portion intermediate the forecastle and the stern being substantially vertical from the water-line downwards to a level below the lower surface of an unbroken ice sheet, the ship bottom in this intermediate portion having a V-shaped configuration in defining a center keel, and at least one additional marine propulsion and steering means on either side of the center keel;

b. The forecastle of the ship's hull above the means water-line being of a pontoon-shaped configuration with parallel side walls and a front wall substantially flat in a lower portion and inclined rearwardly at an acute angle, the front wall extending across the whole width of the ship and below the mean water-line merging gradually into an adjacent portion of wedge-shaped configuration with a center keel, the ship's body including trimming means adapted to lower the forecastle from the mean water-line down to the highest water-line so that the lower edge of the flat front wall portion will be positioned at about the level of the lower surface of the ice sheet, or to lift the forecastle from the means water-line up to the lowermost water-line so that the upper end of the wedge-shaped front portion is above the water-line; and c. driven track and support wheels on either side of the forecastle adjacent the vertical side walls thereof, the track and support wheels adapted to bear on the unbroken ice and to support the forecastle when the same advances onto the ice sheet.

The proposed icebreaker with the pontoon-shaped forecastle breaks off larger ice floes of an increased width, and urges these broken away ice pieces initially merely in a downward direction. Subsequently, when the upper edge of the ice pieces has come into a position below the lower surface of the unbroken continuous ice sheet at either side of the icebreaker, these downwardly pushed ice pieces are shifted sideways. The unique design of the middle ship of the icebreaker vessel has the effect that the broken ice pieces deflected under the ship bottom by the forecastle will be pushed away laterally into a position underneath the rigid ice sheet. The forces required for accelerating the ice pieces in the lateral direction are provided by the V-shaped configuration of the ship bottom and the additional marine propulsion and steering systems.

The pontoon-shaped configuration of the forecastle, taken by itself, would be insufficient for obtaining satisfactory operation because ice pieces that have not been pushed sideways underneath the rigid ice sheet in the region of the forecastle would tend to slide under the middle ship, emerge again behind the ship and ultimately float in the cleared channel. When employing exclusively ships having a V-shaped ship bottom and additional propulsion and steering devices, the effects obtained by the inventive icebreaker cannot be achieved. With a V-shaped ship bottom the forecastle would break up the ice sheet into a great number of relatively small ice pieces, many of which would be urged sidewards by the pointed stem in the region of the water-line and would thus never be pushed downward into a depth below the lower surface of the rigid ice sheet. The ice pieces would therefore tend to accumulate between the hull and the lateral edges of the ice sheet and would ultimately emerge again and float in the cleared channel.

In the now proposed icebreaker vessel the various individual effects are combined in a novel manner and in this combination allow to provide an unobstructed ice-free channel. This is achieved, in accordance with the present invention, by the icebreaker having a pontoon-shaped forecastle, a V-shaped ship bottom and additional propulsion and steering devices at the ship bottom.

For increasing the maneuvering capabilities of the vessel in densely packed ice and avoiding the risk of the vessel getting jammed or locked in the ice, it is very important that the additional propulsion and steering devices assist the rudder operation, and that track and support wheels at the forecastle prevent any jamming of the hull.

The additional propulsion and steering devices may consist of Voith-Schneider propellers or of pivotable jet propulsion units. According to another advantageous embodiment, a plurality of driven track and support wheels may be disposed along either side of the vertical forecastle side walls, the track and support wheels on either side being arranged in tandem or abreast and staggered with respect to the direction of forward movement of the vessel.

To increase the effect of the forecastle-mounted track and support wheels and to prevent deep penetration of the wheels into loosely packed ice, the invention proposes, according to a further embodiment, that the ice sheet engaging rolling surfaces of the track and support wheels are disposed at the same level as or somewhat lower than the lateral edges of the ship bottom. Additionally the track and support wheels and the rolling surfaces thereof as well as the lateral edges of the ship bottom may be connected with heat generating means.

In the following, the icebreaker vessel will be described with reference to the appended drawings in which are illustrated several embodiments of the inventive icebreaker vessel.

Figure 1:
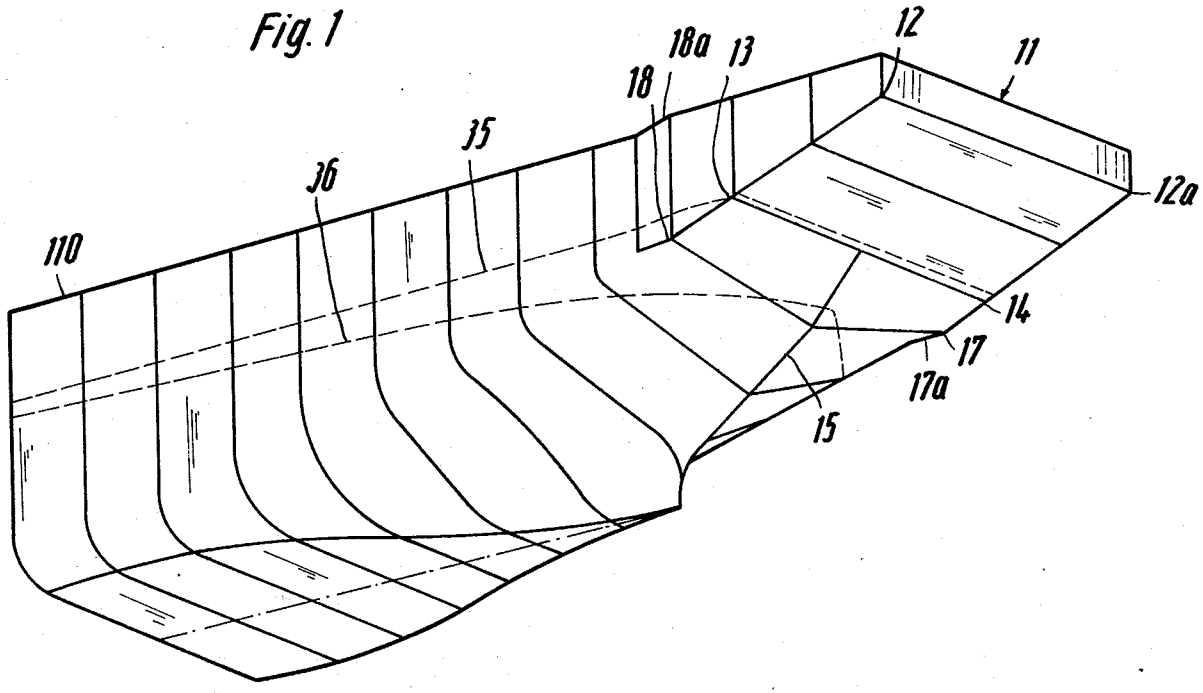
FIG. 1 is a schematical bottom perpsective view of a pontoon-shaped forecastle portion of an icebreaker vessel in accordance with one embodiment of the present invention.

Referring first to FIGS. 1 to 4, the design of the forecastle 11 of the hull 110 is as follows: The forecastle 11 of the hull of the icebreaker vessel is generally of a pontoon-shaped configuration as shown in FIG. 1 and comprises in its front portion a front wall which is substantially flat in a lower portion. The front wall lower portion is inclined rearwardly at an acute angle with the horizontal and is defined by the corners 12, **12*a*, 13 and 14. Above the mean water-line which is indicated by the dashed line 35 in FIG. 1** this front wall is substantially flat and sharp-edged at the sides.

Below the mean water-line 35, the rearwardly inclined front wall of the forecastle 11 gradually merges into an adjacent portion of wedge-shaped configuration defining a center keel 15. The width of the forecastle 11 is substantially equal to or greater than the width of the remaining parts of the ship's hull, from the forward end of the front wall up to the points 17 and 18. Behind these points 17, 18 the width of the forecastle 11 decreases, in defining distinct shoulders **17*a* and 18*a*** respectively.

A flat-type tank not shown in the drawings is located at the inner surface of the front wall in the vicinity of the water-line and serves to heat the ship's skin in this area by internal heating. The heating medium employed may be cooling water from the vessel's engines.

The method of operation of the icebreaker vessel varies, depending upon the actual ice conditions, and in closed ice differs from the method of operation and the effects achieved thereby in discontinuous ice.

Figure 2:
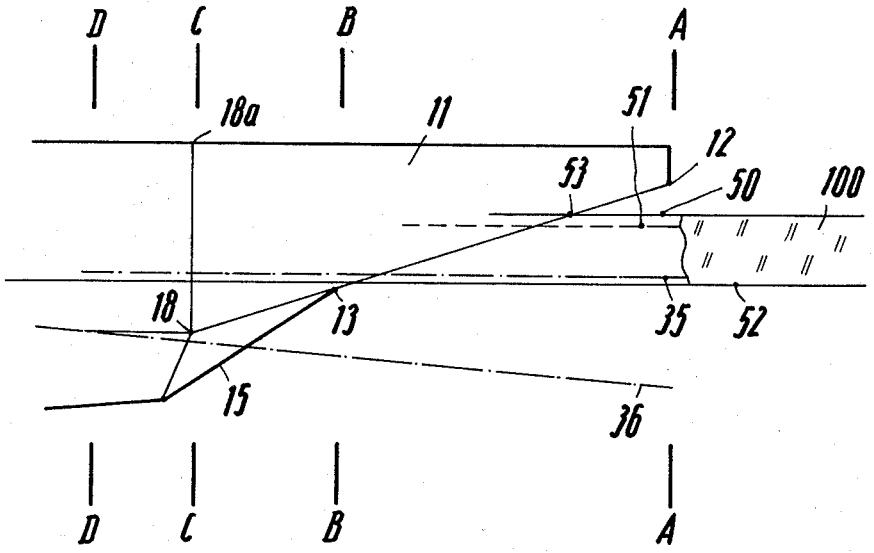
FIG. 2 is a schematical lateral elevational view of the forecastle portion of FIG. 1.
Figure 7:
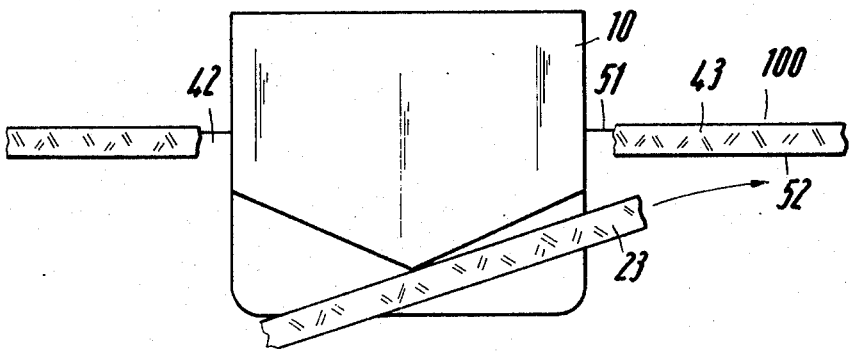
FIG. 7 is a transverse sectional view of the icebreaker vessel of FIG. 6, as seen from the stern, for further illustrating the operation thereof.

In continuous ice sheets, the icebreaker vessel operates as follows: FIG. 2 illustrates the essential characteristics of the novel type of icebreaker vessel. The forecastle 11 moves from left to right toward the ice sheet 100 that is floating on a body of water. The upper surface of the water is indicated by the reference numeral 51. The upper surface 50 of the ice sheet 100 is at a somewhat higher level than the surface of the water 51, and the lower surface 52 of the ice sheet 100 is somewhat lower than the surface of the water 51. At the point 53 the forecastle 11 contacts the ice sheet, and when the vessel now continues in its forward movement, the forecastle 11 will rise and the ice sheet 100 will be lowered. The initial contact point 53 at which the forecastle contacts the ice will thereby shift approximately into the position of point or corner 13 at which is generally reached the breakage limit for breaking away an ice floe. In this manner, there will be broken away an ice floe of a width substantially corresponding to the width of the forecastle. This ice floe will slip downwardly along the line of the center keel 15 into a position shown in FIG. 7 and indicated by the reference numeral 23. In its further forward movement, the forecastle 11 again engages the unbroken ice sheet at the point 53, and the above described sequence will be repeated. All of the subsequently broken away ice floes are of a substantially rectangular shape. Behind the icebreaker vessel will thus be generated a channel of a somewhat greater width than the vessel.

Figure 3:
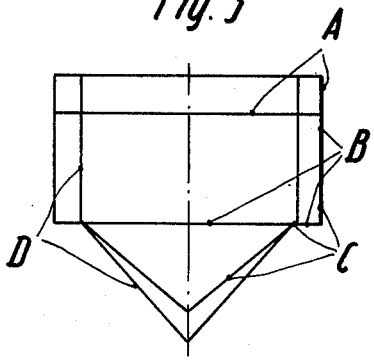
FIG. 3 is a schematical front elevational view of the forecastle of FIG. 1 with the schematical illustration of various rib cross-sections.

The ribs A, B, C and D shown schematically in FIG. 3 are respectively located in the transverse sectional planes indicated by A—A, B—B, C—C and D—D in FIG. 2.

Figure 5:
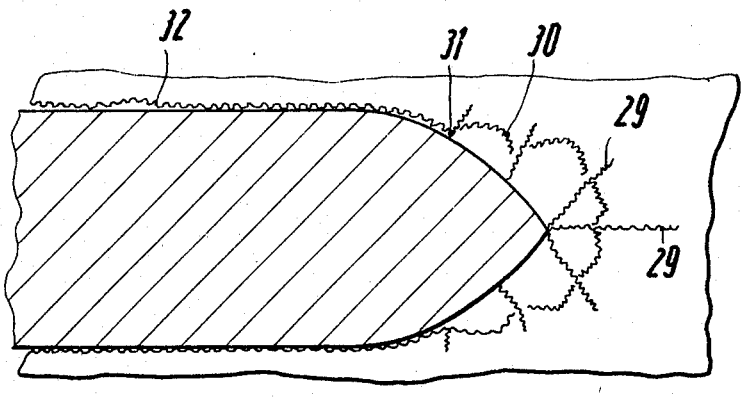
FIG. 5 is a horizontal cross-sectional view of an icebreaker vessel with a conventional forecastle, the icebreaker traversing an ice sheet, as seen from above in looking onto the upper surface of the ice sheet, for demonstrating the operation of the icebreaker vessel.
Figure 6:
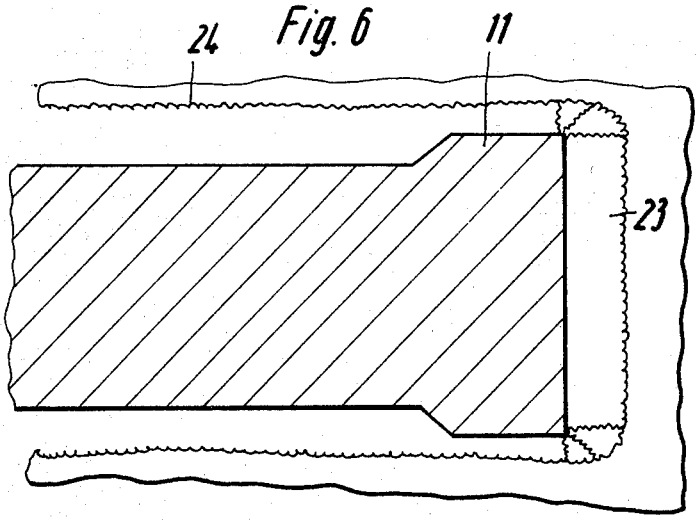
FIG. 6 is a view similar to FIG. 5 but for an icebreaker vessel having a pontoon-shaped forecastle of the type shown in FIG. 1.

For explaining the breaking action of the icebreaker vessel, FIGS. 5 and 6 illustrate horizontal sections along the water line of a heretofore known icebreaker vessel with a conventional forecastle configuration and of an icebreaker vessel having a forecastle 11 of the type shown in FIG. 1 respectively. With the conventional vessel will result the pattern of fracture lines as shown in FIG. 5. This pattern consists of radial fracture lines 29 and arcuate fracture lines 30, with accompanying squeezing effects effects as indicated at 31, i.e., the so-called "shoulder effects." The vessel will produce a narrow channel 32. The forecastle configuration 11, on the other hand, will produce fracture lines of the type shown in FIG. 6. Although these fracture lines are likewise oriented radially and arcuately, no squeezing effects will be encountered. The thus provided channel 24 is of a greater width than the channel 32 of FIG. 5. In the fairly broad central region will be broken substantially larger floes 23 than in the case illustrated in FIG. 5. These larger floes 23 slide under the vessel as illustrated in the transverse sectional view of FIG. 7. Underneath the wedge-shaped portion of the forecastle these larger floes are in an instable position and will tend to tilt upwardly on the one or on the other side of the ship, due to bouyancy forces. In the following cross-sectional portions the ship's body more and more approaches the midship section so that the ice floes sliding along the ship bottom will ultimately be pushed sideways underneath the rigid ice sheet.

This type of icebreaking provides the further advantage that behind the vessel will be provided a channel which is relatively free from ice, unless the continuous ice sheet moves under the influence of currents or wind. Since the forecastle 11 shown in FIG. 1 engages the ice sheet more or less simultaneously across the whole width of the forecastle, the frictional forces encountered are higher than with heretofore known forecastles of a pointed configuration. These friction forces, however, are concentrated along the edges between corners 12 and 13 and corners 12*a* and 14 respectively. In the forecastle, 11 it is therefore particularly advantageous to have recourse to the conventional expedient of heating the ice for reducing friction coefficients. This heating of the ice may be performed most economically by means of the narrow heating tanks 60 and 61 shown in FIG. 4. These heating tanks 60 and 61 extend from corner 12 to point 18 and from corner 12*a* to point 17 respectively. The lateral edges between 12 and 18 and 12*a* and 17 respectively have to withstand furthermore the major portion of the vertically directed ice pressure exerted on the ship's hull and are suitably heated by cooling water supplied from the vessel's engine. The heating is therefore restricted to a relatively small portion of the ship's hull and only for this reason may be carried out economically.

When an ice sheet alternates with open water and pack ice, the vessel must be brought into a trim position so that the vessel is down by the stern and the waterline 35 will be shifted into the position 36 shown in a dashed line in FIG. 1. The method of operation is then as follows: The forecastle is lifted to such an extent that the flat portion of the front wall above the line connecting corners 13 and 14 no longer contacts the ice or no longer engages the ice to a substantial degree, and the V-shaped portion below the line 13 – 14 advances toward the ice sheet in breaking the same. The broken ice floes are therefore pushed sidewards and simultaneously downwards.

Figure 4:
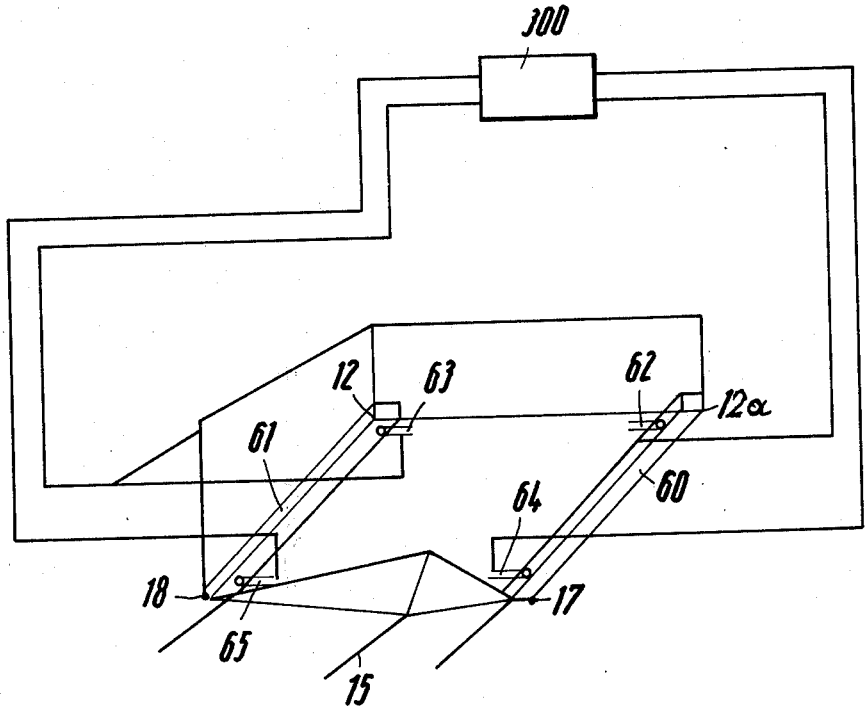
FIG. 4 is a view similar to FIG. 1 showing a portion of the forecastle with heating tanks incorporated therein.

As may be seen from FIG. 1, the rearwardly inclined front wall portion of the forecastle 11 below the waterline gradually merges into a wedge-shaped portion defining a center keel 15. The width of the forecastle 11 from its forward end up to points 17 and 18 is approximately equal to or even somewhat wider than the width of the remaining part of the ship's hull. Behind these points 17, 18 the width of the forecastle decreases, in defining inwardly inclined shoulders 17*a*, 18*a*. The front wall of the forecastle 11 mounts at its inner surface in the vicinity of the water-line narrow heating tanks 60, 61 as shown in FIG. 4. These tanks 60, 61 serve to heat the ship's outer skin by heat exchange from the inner surface, in using cooling water supplied by the vessel's engines. The tanks 60, 61 may consist of thickwalled tubes or pipes of a rectangular cross-section and of a rigidity that enables these tubes to withstand the high forces exerted by the ice against the hull. The heating tanks 60, 61 are connected at their upper ends by feed pipes 62, 63 respectively, and at their lower ends by return pipes 64, 65 respectively to the cooling water closed circuit of the machine unit 300.

For reducing the friction portion of the overall forward motion resistance and for generating an ice-free channel, the hull 110 of the further embodiment of the icebreaker shown in FIGS. 5–8 is of a configuration as follows:

In FIG. 8 to 11, the hull of the icebreaker vessel is indicated by the reference numeral 110, and the forecastle likewise by the reference numeral 11. The side walls 112, 113 of the hull 110 are substantially vertical up to a line 115, as may be seen in FIG. 8. This line 115 is at a level lower than the lower surface of the unbroken ice sheet 100. The ship bottom 118 depending downwardly and inwardly from the side walls 112, 113 is generally of a V-shaped configuration. The bottom wall portion 118*a*, 118*b* on either side of the center keel 119 may likewise be arcuately curved in defining a slightly concave profile towards the hull 110. This configuration may best be seen from FIGS. 9 and 10. Alternatively, the side walls 112, 113 and the ship bottom 118 in the region between forecastle 11 and stern may be arranged in the above described manner.

Figure 10:
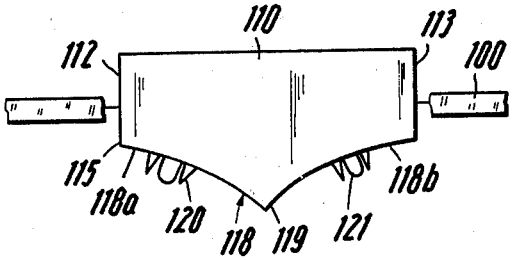
FIG. 10 is a transverse sectional view of the ship body of FIG. 8, along the line X–X.

Additional marine propulsion and steering systems are mounted at the ship bottom 118 on either side of the center keel 119 in a midship location. In the embodiment of the icebreaker vessel shown in FIGS. 8 to 11, these additional marine propulsion and steering system consist of Voith-Schneider propellers 120, 121. Alternatively, more than two Voith-Schneider propellers may be mounted at the ship bottom 118 (FIGS. 10 and 11).

Figure 11:
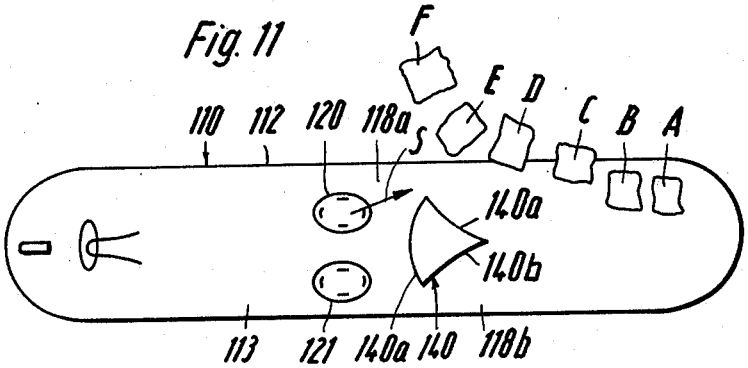
FIG. 11 is a bottom view of the icebreaker vessel of FIG. 8, for illustrating the operation thereof.

The bottom view of FIG. 11 serves to illustrate the operation of the icebreaker vessel. The path of movement of an ice floe which has been selected at random from a multitude of similar ice floes is illustrated by its various positions A to F from the position A in which the ice floe is broken from the ice sheet up to the position F in which the ice floe comes to a rest underneath the remaining ice sheet in a location that is laterally displaced with respect to the hull. The transient intermediate positions of the ice floe are indicated by the positions B, C, D and E. From position A to position B, the ice floe is moved initially in a downward direction. From position B to position C, the ice floe is acclerated sideways, due to the V-shaped configuration of the ship bottom 118 and its own buoyancy. This lateral acceleration is terminated as soon as the ice floe has come into the position D. In this position D the ice floe will then be accelerated further sideways toward the position E by the jet stream S of the Voith-Schneider propeller 120. Therefore the ice floe does not emerge at the side wall of the ship but is pushed underneath the rigid ice sheet 100 and will finally come to a rest in the position F.

Figure 8:
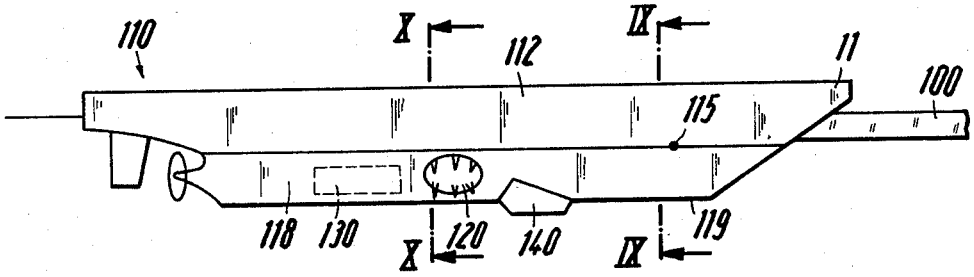
FIG. 8 is a lateral elevational view of an icebreaker vessel breaking an ice sheet, the icebreaker vessel having a V-shaped ship bottom and additional marine propulsion and steering means at the ship bottom.
Figure 9:
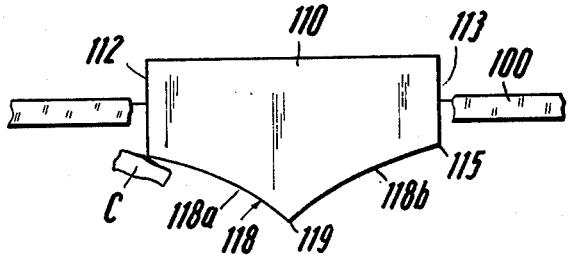
FIG. 9 is a transverse sectional view of the ship body of FIG. 8, along the line IX—IX.

This sequence will be obtained only under the condition that the line 115 of the hull 110 is at a level lower than the lower surface of the ice sheet 100, and this may be obtained in a conventional manner by pumping out or flooding appropriately dimensioned double-bottom containers for water ballast 130 as schematically indicated in FIG. 8. Another condition to be met is that magnitude and direction of the jet streams of the Voith-Schneider propellers 120 and 121 may be adapted to the current pattern underneath the vessel to ensure that these jet streams S will become effective in the position D. This may be readily achieved by the well known properties of Voith-Schneider propellers whereby the control of the ice movements underneath the vessel by conventional measuring devices such as echo sounders may provide the required inputs for controlling the propellers.

For increasing the efficiency of operation of the Voith-Schneider propellers and for protecting the propellers against inadvertent impacts by ice floes, a displacement body 140 is mounted on the ship bottom 118 in the line of the center keel 119 forward of the propellers (see FIGS. 8 and 11). This displacement body 140 is of a wedge-shaped configuration, and the apex of the wedge faces toward the forecastle 11. The side walls 140*a*, 140*b* of the displacement body 140 flare outwardly in the general direction of the Voith-Schneider propellers and serve as deflectors for ice floes that have not been deflected laterally despite of the V-shaped configuration of the ship bottom 18. The side walls 140*a*, 140*b* of the displacement body 140 may additionally be of an arcuate configuration to constitute guide surfaces for the lateral deflection of ice floes. The side wall 140*c* facing the Voith-Schneider propellers of the displacement body 140 is substantially of an arcuate configuration, in thereby enhancing the effects of the jet streams S discharged by the Voith-Schneider propellers.

Figure 12:
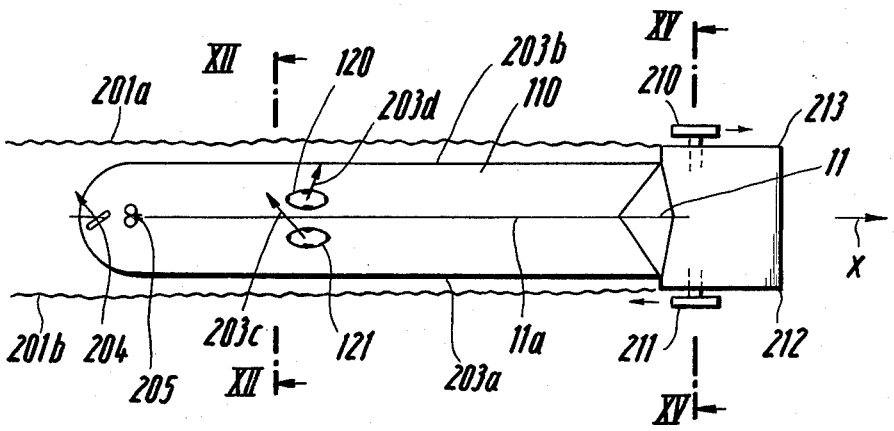
FIG. 12 is a bottom view of an icebreaker breaking an ice sheet, the icebreaker vessel having a pontoon-shaped forecastle, a V-shaped ship bottom, additional marine propulsion and steering devices at the ship bottom and driven track and support wheels.

The icebreaker shown in FIG. 12 combines the characteristics of the two above described embodiments insofar as the hull 110 includes a pontoon-shaped forecastle and a V-shaped ship bottom as well as additional marine propulsion and steering systems.

FIG. 12 is a bottom view of an icebreaker vessel traveling in the direction of the arrow *x* across an ice sheet 100. The icebreaker vessel breaks into the ice sheet 100 a channel defined by the lines 201*a*, 201*b*. The forecastle 11 of the icebreaker is pontoon-shaped whereas the side walls of the middle ship 11*a* are vertical and the bottom of the middle ship is wedge-shaped. Along the ship bottom are mounted on the port side 203*a* and on the starboard side 203*b* a marine propulsion and steering system. These systems consist of Voith-Schneider propellers 120, 121 applying thrust forces generally outwardly in a symmetrical pattern. The systems may be connected to a controller on the bridge which controller allows to vary the thrust direction of the Voith-Schneider propellers as shown in FIG. 12 at 203*c* and 203*d* respectively so that under special circumstances may be generated a resulting force acting in the sense of a change-of-course of the vessel, in assisting the effects by the rudder blade 204.

Figure 13:
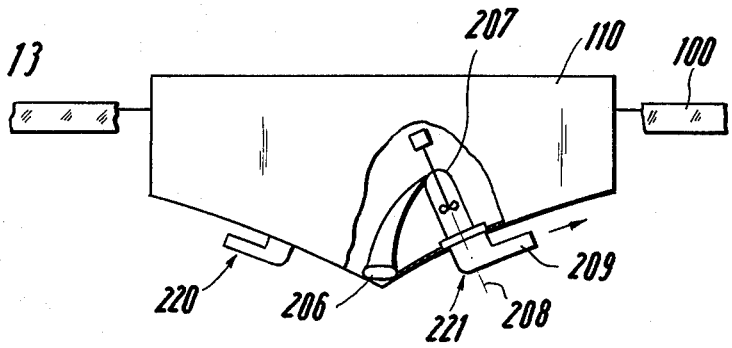
FIG. 13 is a partly broken away transverse sectional view of the icebreaker of FIG. 12, along the line XII—XII, for illustrating jet propulsion devices in the middle ship portion.

When damages to the Voith-Schneider propellers 120, 121 by the ice have to be anticipated, then the Voith-Schneider propellers may be replaced by conventional jet propulsions units 220, 221 as schematically shown in FIG. 13.

Figure 14:
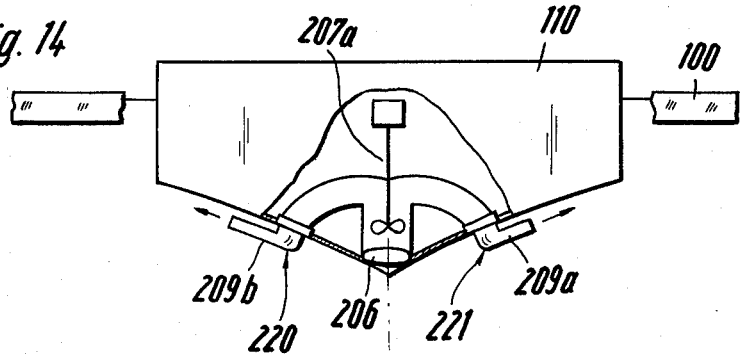
FIG. 14 is a view similar to FIG. 13, along the line XII—XII of FIG. 12, for illustrating a modification of the jet propulsion devices which are supplied by a common propeller pump.

When employing jet propulsion units 220, 221 each jet propulsion unit is supplied with water drawn at the port side into an intake opening 206 by means of a propeller pump 207. The propeller pump 207 supplies the water from its pressure side to a jet nozzle 209 which is pivotably mounted about an axis 208. A corresponding unit not shown in FIG. 13 is provided for the starboard side. In a modification as schematically shown in FIG. 14, a common propeller pump 207*a* may be employed to supply both nozzles 209*a* and 209*b* with water.

Figure 15:
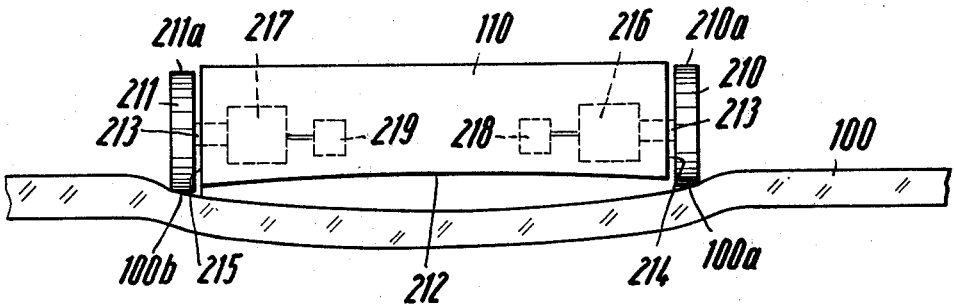
FIG. 15 is a transverse vertical sectional view of the icebreaker of FIG. 12, along the line XV—XV through the wheel axes.
Figure 16:
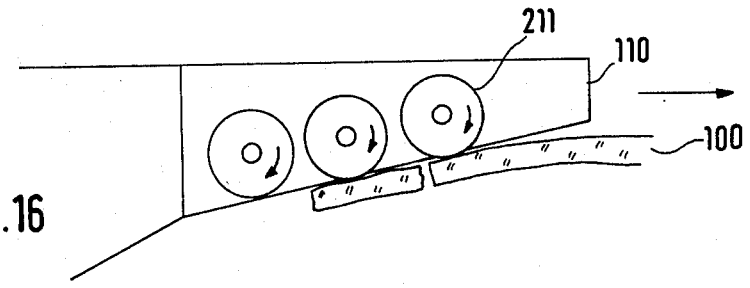
FIG. 16 is a partial side view of the icebreaker vessel hull illustrating the position of track and support wheels.
Figure 17:
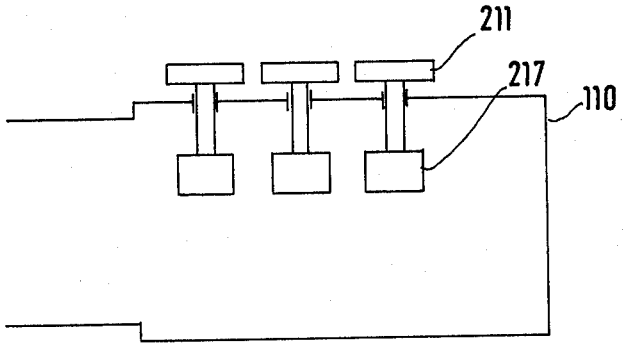
FIG. 17 is a top view of the portion of the hull shown in FIG. 16.
Figure 18:
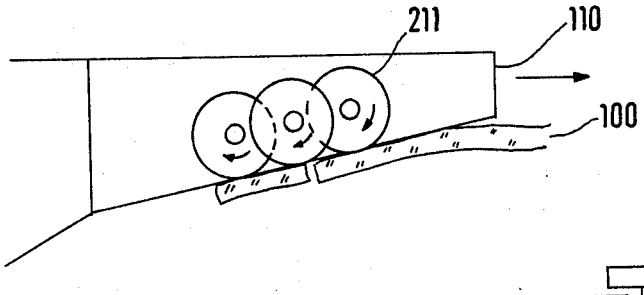
FIG. 18 is a partial side view of another embodiment of the track and support wheels represented in FIG. 16.
Figure 19:
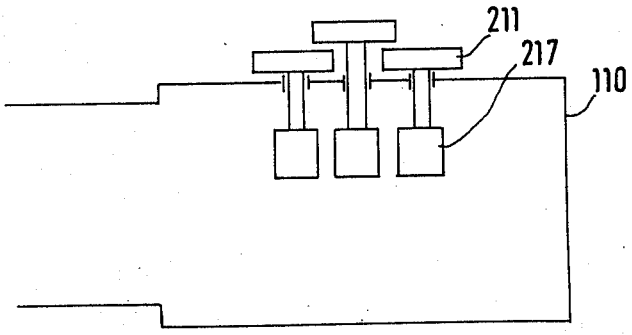
FIG. 19 is a top view of the arrangement shown in FIG. 18.

Another important expedient for avoiding the jamming of the hull in the ice consists in an additional wheel drive assembly. An additional wheel drive assembly in combination with a pontoon-shaped forecastle allows to arrange the track and support wheel indicated by 210 and 211 in FIG. 15 so that these wheels will take up the major part of the vertical forces exerted by the vessel onto the still unbroken ice sheet, in thus transmitting considerable propelling forces to the ice. In order to avoid that the track and support wheels 210, 211 break into the ice, the lowermost parts of the rolling surfaces 210*a*, 211*a* of the track and support wheels 210, 211 are disposed at about the same level as or somewhat lower than the planar or slightly upwardly curved ship bottom 212. The ship bottom 212 is in any case disposed below the wheel axles 213. By this expedient, the still unbroken ice sheet 100 is loaded most in the regions 100*a* and 100*b* underneath the wheels.

Instead of a pair of track and support wheels 210, 211 there may likewise be provided several track and support wheels along both vertical side walls 214, 215 of the forecastle 11 of the hull 110. These several track and support wheels may be arranged either in tandem or abreast and staggered with respect to the direction of forward movement of the vessel, note FIGS. 16, 17 18 and 19. The track and support wheels 210, 211 are driven by electric motors 218, 219 via gear boxes 216, 217 respectively (see FIG. 15). Any other suitable drive units may likewise be employed. For preventing fast-freezing effects, the track and support wheels 210, 211 and the parts of the ship's hull adjacent thereto may be provided with internal heating devices. The required heat energy may be supplied by the waste heat energy generated in the machine unit of the vessel.

By driving the track and support wheel on the one side of the vessel at a higher speed or with a different sense of rotation than the corresponding track and support wheel at the other side of the hull, considerable moments may be exerted about the vertical axis of the vessel, and since vessel and ice are frictionally connected these moments may also be employed intermittently, in order to forestall any jamming of the vessel. When both track and support wheels are driven in the same rotational sense and at the same speed than the ice breaker vessel is provided with an additional pushing force, with the result that the forward motion resistance between the still unbroken ice and the forecastle is largely eliminated in comparison to an icebreaker vessel having no track and support wheels. In thick ice and with the resulting low vessel velocity the propulsion efficiency of the wheel drive approaches a factor of 100 percent, provided no slippage occurs, whereas with descreasing forward velocity the propulsion efficiency of the propeller approaches zero. These facts contribute in a substantial degree to the energy-saving operation of the icebreaker vessel.

For preventing slippage of the driven track and support wheels 210, 211 during the transfer of forces onto the ice, the track and support wheels may be provided with threads not shown in the drawings. For the same reason, the track and support wheels 210, 211 must be of a diameter as large as feasible. If larger diameters cannot be accommodated due to design restrictions, then a greater number of track and support wheels in a tandem or an abreast and staggered arrangement may be provided.

The embodiments of the invention in which an exclusive property or privilege is claimed are defined as follows:

1. An icebreaker vessel for cutting through an unbroken ice sheet comprising a longitudinally extending ship's hull, said ship's hull having a forecastle at its forward end, a stern at its rearward end and an intermediate portion extending longitudinally therebetween, said hull having a top surface and a bottom surface and a mean water-line extending longitudinally about said hull intermediate its top and bottom surfaces, said forecastle has a pontoon-shaped configuration with a pair of parallel vertical side walls extending in the longitudinal direction and a front wall facing in the forward direction of said hull and extending across said hull between said side walls, said front wall having a substantially planar lower portion inclined rearwardly and downwardly from the forward end of the hull at an acute angle with the horizontal, said front wall extending across the full width of the ship's hull, said forecastle including a wedge-shaped portion with a center keel merging into the lower end of said lower portion below the mean water-line, the wedge shaped portion comprising two sections each sloping inwardly and downwardly from the lower end of an opposite one of said vertical side walls to the center keel with the center keel sloping downwardly from the lower end of said lower portion toward the stern of the ship's hull, at least the intermediate portion of said hull extending rearwardly from said forecastle having side walls extending vertically downwardly at least in the range from the water-line to a level located below the lower surface of the ice sheet to be broken, and at least the bottom of said hull adjacent to said forecastle and extending between the vertically extending side walls of said intermediate portion having a V-shaped configuration forming a center keel aligned with the center keel of the wedge-shaped portion of said forecastle, with the center keel of said intermediate portion connected directly to and extending downwardly from the lower end of the center keel of said forecastle toward the stern of the ship's hull.

2. An icebreaker vessel for cutting through an unbroken ice sheet comprising a longitudinally extending ship's hull, said ship's hull having a forecastle at its forward end, a stern at its rearward end and an intermediate portion extending longitudinally therebetween, said hull having a top surface and a bottom surface and a mean water-line extending longitudinally about said hull intermediate its top and bottom surfaces, said forecastle has a pontoon-shaped configuration with a pair of parallel vertical side walls extending in the longitudinal direction and a front wall facing in the forward direction of said hull and extending across said hull between said side walls, said front wall having a substantially planar lower portion inclined rearwardly and downwardly from the forward end of the hull at an acute angle with the horizontal, said front wall extending across the full width of the ship's hull, said forecastle including a wedge-shaped portion with a center keel merging into the lower end of said lower portion below the mean water-line, at least the intermediate portion of said hull extending rearwardly from said forecastle having side walls extending vertically downward at least in the range from the water-line to a level located below the lower surface of the ice sheet to be broken, and at least the bottom of the said hull adjacent to said forecastle and extending between the vertically extending side walls of said intermediate portion having a V-shaped configuration forming a center keel aligned with the center keel of the wedge-shaped portion of said forecastle, and driven track and support wheels located on each side of said forecastle adjacent to and extending outwardly from said parallel side walls of said forecastle, said track and support wheels arranged to bear on the unbroken sheet of ice and to support said forecastle as it is advanced onto the sheet of ice.

3. An icebreaker vessel, as set forth in claim 2, wherein a plurality of said driven track and support wheels are disposed along each side of said vertical parallel side walls of said forecastle.

4. An icebreaker vessel, as set forth in claim 3, wherein said wheels on each side of said forecastle are arranged in tandem and are staggered with respect to the direction of the forward movement of the vessel.

5. An icebreaker vessel, as set forth in claim 3, wherein said wheels on each side of said forecastle are arranged abreast and are staggered with respect to the direction of forward movement of the vessel.

6. An icebreaker vessel, as set forth in claim 2, wherein the rolling surfaces of said wheels which engage the surface of the ice sheet are disposed at least at the same level as the adjacent surface of the lower portion of said front walls of said forecastle.

7. An icebreaker vessel, as set forth in claim 2, wherein the junction of said side walls of said forecastle and said side walls of the intermediate portion of said hull extend inwardly from said forecastle to the intermediate portion of said hull.

8. An icebreaker vessel, as set forth in claim 2, wherein heating tanks are provided within said forecastle located at the junction of said said side walls and said lower portion of said front wall for heating the ice sheet.

9. An icebreaker vessel, as set forth in claim 2, wherein said intermediate part of said hull having a flat bottom portion extending between the V-shaped portion of said intermediate portion adjacent said forecastle and said stern.

10. An icebreaker vessel, as set forth in claim 2, wherein the bottom of said hull from said forecastle to said stern having a V-shaped configuration.

* * * * *